United States Patent [19]

Murakami

[11] Patent Number: 4,887,978

[45] Date of Patent: Dec. 19, 1989

[54] INTERLOCK DEVICE FOR CONNECTOR-JUNCTION BLOCK ASSEMBLY

[75] Inventor: Yoshihiro Murakami, Aichi, Japan

[73] Assignee: Yazaki Corporation, Tokyo, Japan

[21] Appl. No.: 233,004

[22] Filed: Aug. 17, 1988

[30] Foreign Application Priority Data

Aug. 19, 1987 [JP] Japan ..... 62-125162[U]

[51] Int. Cl.[4] ..... H01R 13/74

[52] U.S. Cl. ..... 439/553; 439/557

[58] Field of Search ..... 439/553–555, 439/557, 558, 567, 715–717

[56] References Cited

U.S. PATENT DOCUMENTS

| | | | |
|---|---|---|---|
| 3,989,343 | 11/1976 | Lucius et al. | 439/557 |
| 4,171,862 | 10/1979 | Krasser | 439/717 |
| 4,469,393 | 9/1984 | Chewning, Jr. et al. | 439/717 |

FOREIGN PATENT DOCUMENTS

| | | | |
|---|---|---|---|
| 570717 | 12/1975 | Switzerland | 439/557 |
| 590568 | 8/1977 | Switzerland | 439/717 |
| 1542972 | 3/1979 | United Kingdom | 439/717 |

*Primary Examiner*—Gary F. Paumen

*Attorney, Agent, or Firm*—Robbins & Laramie

[57] ABSTRACT

The interlock device for a connector (e.g. a fusible link connector)—junction block assembly includes a first lock mechanism for locking the insulating housing of the connector in position, against downward displacement, within the mounting framework of the junction block, and a second mechanism for locking the insulating housing in the same position, against upward displacement, within the mounting framework of the junction block substantially simultaneously with the first lock mechanism. The first and second lock mechanisms respectively each include a pair or pairs of wedge-shaped lock pawls with one provided on the insulating housing and the other on the mounting framework. Mating pawls, respectively, have slidable contact surfaces with oppositely directed gradients and oppositely facing lock surfaces. The device, further, has a first resilient release lever for releasing the first lock mechanism when desired to pull the connector downwardly and a second resilient release lever for releasing the second lock mechanism when desired to pull the connector upwardly for maintenance or servicing of the connector. Replacement or inspection of the inner components of the connector, therefore, can be effected quickly conveniently simply by opening the top cover of the junction block.

8 Claims, 8 Drawing Sheets

INTERLOCK DEVICE FOR CONNECTOR-JUNCTION BLOCK ASSEMBLY

BACKGROUND OF THE INVENTION

1. Field of the Invention:

The invention relates to an interlock device for a junction block and a connector e.g. a fushible link connector, the inner components of which are subjected to frequent inspection or replacement, for use in automobile electric system circuits.

2. Description of the Prior Art:

Conventionally, it has been necessary, when the junction block is to be connected to a source battery, or heavy current connectors are to be interconnected, to effect secure threadable fastening of the connector terminals and their mating terminals together for attainment of reliable electric contact between them.

The junction block usually includes a block body, a top cover and a bottom cover. The block body has a mounting framework formed interiorly for housing in it a fusible link connector composed of an insulating housing and fusible links, which will be hereinafter referred to as a "FL connnector" for brevity.

For interlocking the two of the FL connector and the junction block, the insulating housing is provided with a lateral insertion guide having a lock pawl on it while the mounting framework of the junction block is provided with a cooperating lock pawl, so that the two members are tightly interlocked with the complementally shaped lock pawls being engaged with each other. This interlock can be released by manual operation of a release lever of resilient material.

With such a conventional interlock mechanism as constructed above, however, the problem is that in case the fusible links are necessarily replaced due to blowout of the fusible elements, the release lever has to be urged outwardly or away from the lock pawl on the insertion guide of the insulating housing, thereby releasing the two lock pawls from interengagement and subsequently pulling the FL connector downwardly relative to the mounting framework of the junction block. This procedure in practice entails the necessity of removing the whole of the junction block since the junction block is usuallly mounted in the engine room with its bottom cover fixedly secured on the car chassis or bracket. This naturally results in a significantly time-consuming work of maintenance.

The invention therefore has been devised to eliminate the above described problems in the prior art interlock device by providing an interlock device which makes it possible to displace the connector in both directions, upwardly and downwardly, relative to the junction block, hence assuring facilitation of the maintenance work involved.

SUMMARY OF THE INVENTION

According to the invention, there is provided an interlock device for a connector—junction block assembly wherein the connector includes connector terminals accommodated within an insulating housing, the junction block forming therein a mounting framework for slidably detachably mounting the connector therein, characterized in that:

the insulating housing is provided at its one side wall thereof with an insertion guide extending in a direction of inserting the connector into the mounting framework, the insertion guide being provided at its upper half portion with a first lock pawl of wedge shape having an upwardly tapered slide surface and a downwardly facing horizontal lock surface, and a couple of second lock pawls spaced apart horizontally from each other and immediately below the first lock pawl off to the right and left, the second lock pawls having downwardly tapered slide surfaces and upwardly facing lock surfaces, respectively; and the mounting framework is provided on a portion of its inner wall confronting the one side wall of the insulating housing with guide rails for cooperating with the insertion guide on the insulating housing, and within a cavity defined between the guide rails and the inner wall of the mounting framework are provided a first release lever of resilient material and a second release lever of resilient material extending upwardly in the mounting framework from the inner wall, the first release lever being provided on its inner surface with a third lock pawl having a downwarly tapered slide surface and an upwardly facing horizontal lock surface, the third lock pawl being adapted for engagement with the first lock pawl when the connector and the junction block are interlocked, the second release lever being provided on its inner surface with a couple of fourth lock pawls having upwardly tapered slide surfaces and downwarly facing horizontal lock surfaces, respectively, the fourth lock pawls being adapted for engagement with the second lock pawls when the connector and the junction block are interlocked; whereby there is provided a double interlock mechanism wherein after the interlock is effected through the manipulation of the first release lever the first and third lock pawls can be disengaged from each other thus allowing the connector to be pulled downwardly relative to the mounting framework, while the second and fourth lock pawls can be disengaged from each other through the manipulation of the second release lever thus allowing the connector to be pulled upwardly relative to the mounting framework.

Further, there is provided an interlock device for a connector—junction block assembly characterized in that all of the lock elements metioned above are provided in an arrangement opposite to that specified above, that is, the insertion guide carrying the first and second lock pawls are provided on the inner wall of the mounting framework of the junction block while the first and second release levers carrying the third and fourth lock pawls along with the guide rails are provided on the one side wall of the insulating housing, with effects equal to those obtained in the above embodiment.

Still further, there is provided an interlock device for a connector—junction block assembly further characterized in that the insulating housing is provided on its other side wall with a guide plate having a middle elongated slot open at the top while the mounting framework is provided, on a portion of its inner wall confronting the guide plate, with guide rails for cooperating with the guide plate on the insulating housing and a stopper between and atop the guide rails adapted for slidable engagement in the elongated slot.

Yet further, there is provided an interlock device for a connector—junction block assembly further characterized in that the vertical distance from the lock surface of the first lock pawl to the lock surfaces of the second lock pawls and that from the lock surface of the third lock pawl to the lock surfaces of the fourth lock pawls are selected as small as possible.

And yet further, there is provided an interlock device further characterized in that the mating lock pawls i.e. the first and third lock pawls or the second and fourth lock pawls are substantially identical in configuration with the same gradient of tapered slide surface.

BRIEF DESCRIPTION OF THE DRAWINGS

The details of the invention will now be described with reference to the accompanying drawings in which:

FIGS. 7 through 10 show a prior art interlock device wherein FIG. 7 is an explosive perspective view of the device, FIG. 8 is a perspective view of the insulating housing in FIG. 7 taken in the direction of arrow F, FIG. 10 shows how the insulating housing and the mounting framework are interlocked:

DETAILED DESCRIPTION OF THE PREFERRED EMBODIMENTS

Figure 1:
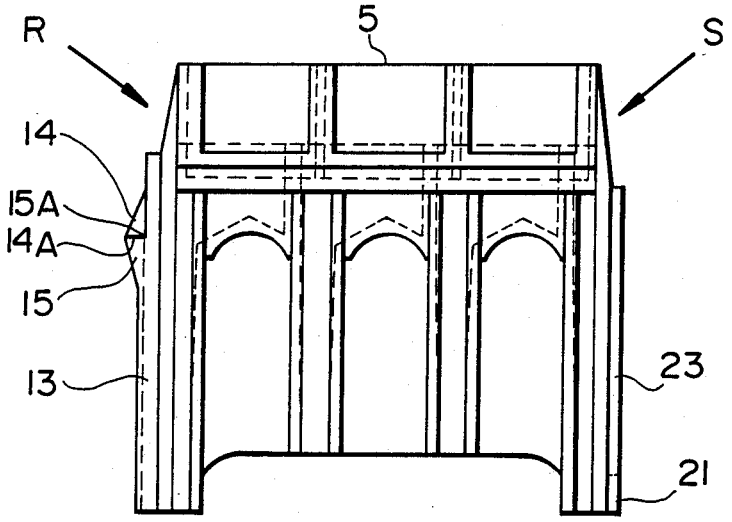
FIG. 1 is a front elevational view of an insulating housing of a screw fastening type connector incorporating a preferred embodiment of an interlock device according to the invention.
Figure 2:
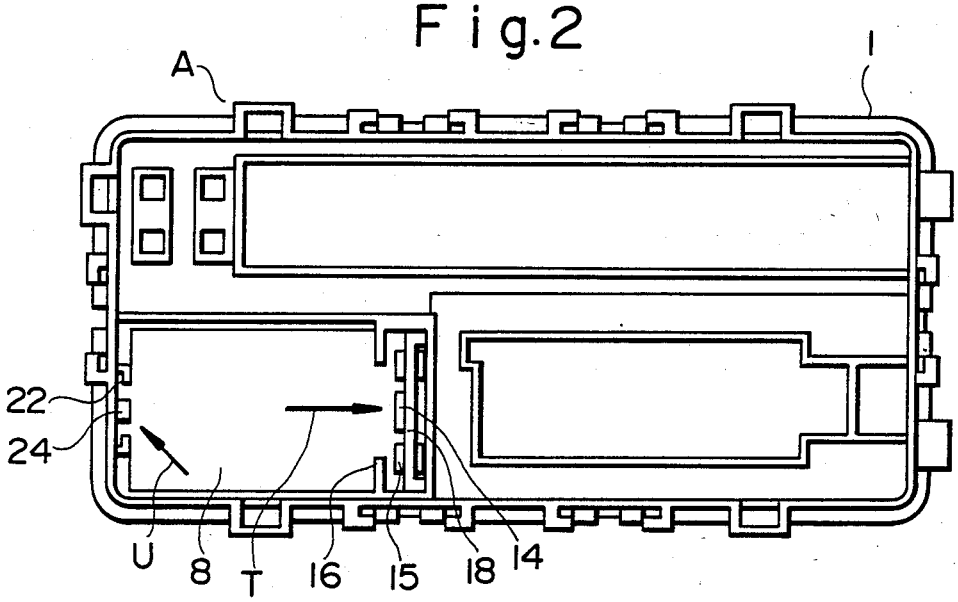
FIG. 2 is a plan view of a block body of a junction block having a mounting framework.

The prior art interlock device will now be described by reference to FIGS. 7 through 10 of the drawings.

A generally indicates a plastic fabricated junction block composed of a block body 1, a top cover 2 and a bottom cover 3. B generally indicates a fusible link connector (FL connector) which includes fusible links 4 and an insulating housing 5. In the block body 1 is formed a mounting framework 8 for accomodation of the insulating housing 5.

The fusible links 4 have protective casings 4A made of synthetic resin for accomodating fusible sections (not shown) and paired connector terminals 4B. The terminals 4B are provided with grooves or apertures 4C for the receipt of fastening screws while the insulating housing 5 is provided on its side wall with corresponding nuts 5A, thereby effecting secure fastening-up of the terminals 4B and their mating terminals C by means of the screws D.

Figure 7:
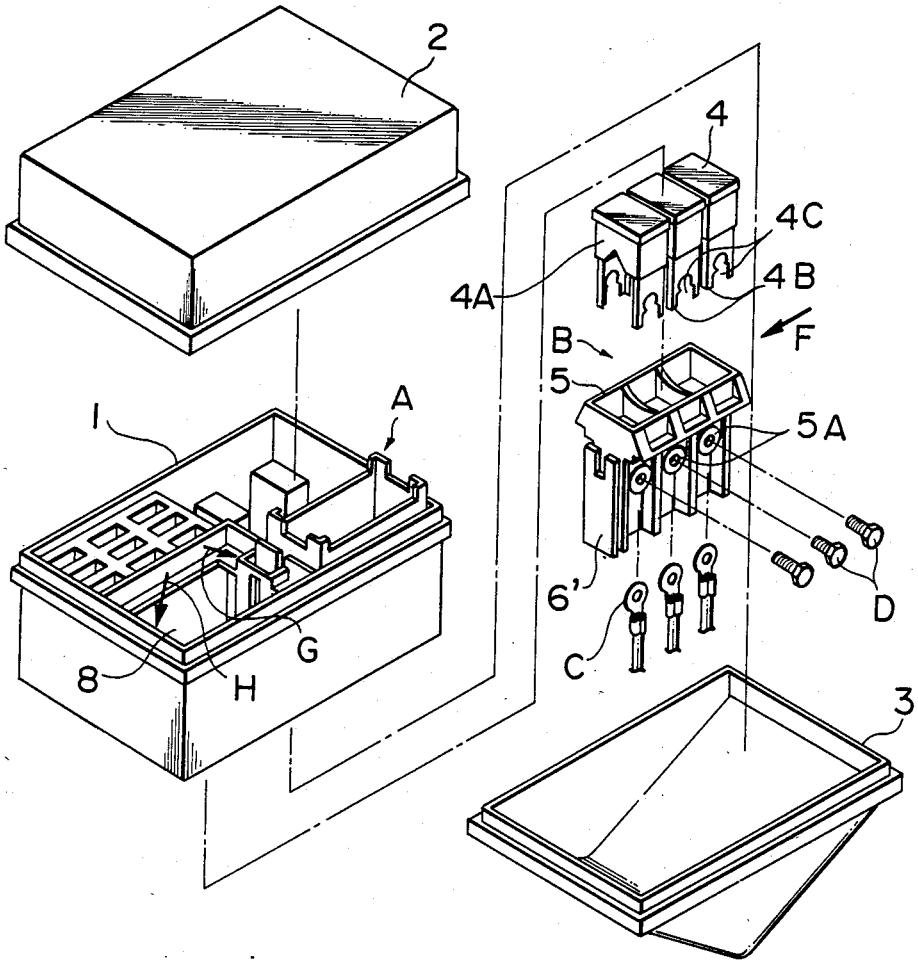
Fig. 7 PRIOR ART
Figure 8:
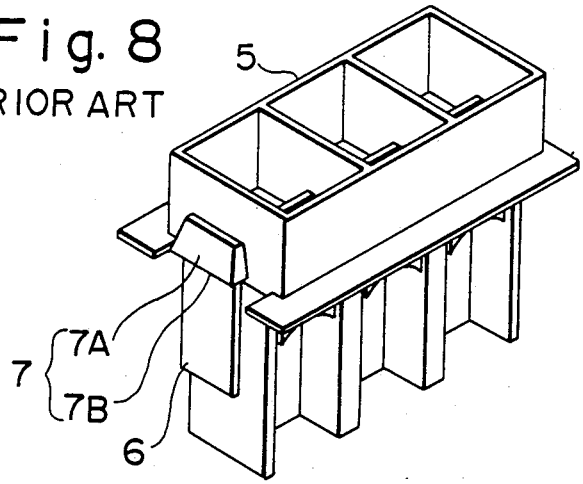
Fig. 8 PRIOR ART

In this arrangement of FL connector and junction block the insulating housing is provided on both ends with plate-shaped insertion guides 6 and 6', one of which guides 6 being provided on its upper portion with a lock pawl 7 of wedge shape including a downwardly facing lock surface 7B and an upwardly tapered slide surface 7A (See FIG. 8). Meanwhile, the other guide 6' is formed with a slot atop (FIG. 7).

Figure 10:
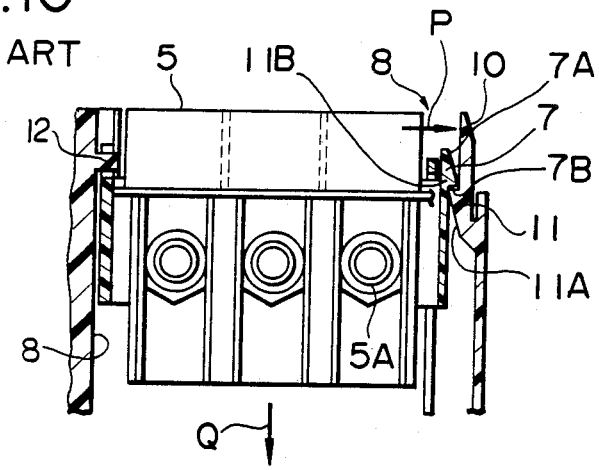
Fig. 10 PRIOR ART
Figure 9A:
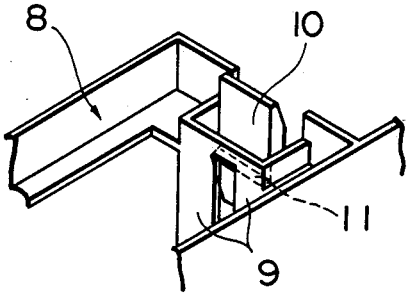
Fig. 9A PRIOR ART
FIGS. 9A and 9B are perspective partial views of the mounting framework in FIG. 7 taken in the direction of arrows G and H, respectively.
Figure 9B:
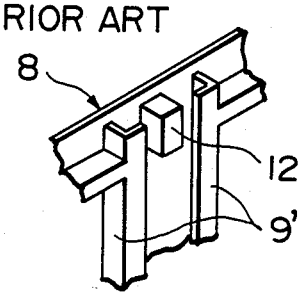
Fig. 9B PRIOR ART

On the other hand, the mounting framework 8 formed in the junction block A is provided at its opposite inner end wall portions with paired guide rails 9,9 and 9',9', respectively (See FIGS. 9A and 9B). As shown in FIG. 9A and FIG. 10, between the paired guide rails 9,9 and the inner wall of the junction block is provided a plate-shaped release lever of resilient material 10 as extending upwardly of the framework 8, integrally with and from the inner wall of the framework. The release lever 10 is provided with a further lock pawl also of wedge shape 11 having an upwardly facing lock surface 11B and a downwardly tapered slide surface 11A, which pawl 11 projects integrally with and from the release lever 10. In the middle and upper portion of the guide rails 9',9', is provided a stopper 12 secured on the inner wall of the mounting framework 8.

With the thus described construction, the interlock between the junction block A and the FL connector B takes place as follows.

First, the fusible links 4 are applied to the insulating housing 5 so that the mating terminals C are securely fastened to the connector terminals 4B by means of the screw D, as described earlier. As shown in FIG. 10, then, the insulating housing 5 is thrust into the mounting framework 8 from below with the insertion guides 6 and 6' being in alignment with the guide rails 9 and 9', respectively. Initially, in this instance, the plate-like release lever 10 is flexed outwardly by the urging force exerted by the upwardly tapered slide surface 7A of the lock pawl 7 through the slidably mating surface 11A of the lock pawl 11 while the pawl 7 is riding on the latter pawl 11. The moment the pawl 7 then overpasses the lock pawl 11, the release lever 10 springs back or restores its original position due to resiliency causing the lock surface 7B to engage the cooperating surface 11B of the pawl 11. At the same time, the upper slot of the insertion guide 6' on the opposite end side of the insulating house 5 is kept abutted against the stopper 12 on the inner wall of the framework 8.

In this manner, the insulating housing 5 (or the FL connector B) is locked in position with snap action within the mounting framework 8 of the junction block A. Subsequently, the top cover 2 and the bottom cover 3 are applied to the thus interlocked combination of the FL connector B and juction block A.

According to the above described arrangement of the prior art interlock device, when the fusible links need to be replaced due for example to blowout of the fuse elements, it is necessary to urge the release lever 10 in a direction shown at P in FIG. 10 so as to disengage the lock pawl 11 from the cooperating pawl 7, and draw the FL connector B out of the framework 8 downwardly in a direction indicated by the arrow Q. This, however, necessitates in practice removal of the junction block in its entirety since the junction block A is normally mounted in the engine room, etc. with its bottom cover 3 securely fixed on the car chassis or bracket. Hence, the maintenance work involved is objectionably accompanied by significant time consumption.

This drawback of the prior art device can be eliminated by use of the inventive interlock device which will be described of its detail with reference to FIGS. 1 through 6 wherein parts similar to those shown and described in connection with FIGS. 7 through 10 will be denoted by the same reference characters.

The inventive device is similar in structure to the prior art one in that it includes a FL connector B of the screw fastening type wherein the connector terminals 4B received in the insulating housing 5 are screw fastened to the mating terminals C, and a junction block A having a mounting framework 8 adapted for slidably detachably mounting the FL connector B. Namely, the junction block A includes the body 1, top cover 2 and bottom cover 3. The block body 1 has the mounting framework 8 formed in it. The FL connector B includes the insulating housing 5 adapted to be fitted in the mounting framework, and fusible links 4.

Figure 3A:
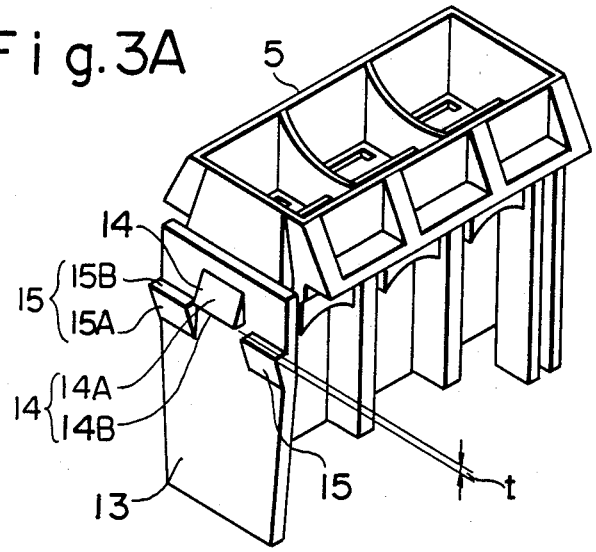
FIGS. 3A and 3B are perspective views of FIG. 1 insulating housing taken in the direction of arrows R and S, respectively.

According to the invention, as shown in FIG. 3A, the insulating housing 5 is provided at one end wall with a plate-shaped insertion guide 13 extending in the direction in which the FL connector is inserted into the mounting framework 8 of the junction block A. The insertion guide 13, in turn, is provided adjacent its top portion with a first lock pawl 14 of a generally wedge-like configuration having a downwardly facing lock surface 14B and an upwardly tapered slide surface 14A, and a pair of second lock pawls 15 and wedge shape however being disposed spaced apart horizontally from each other and immediately below the first pawl 14 off to the right and left. Each second lock pawl 15 also includes an upwardly facing lock surface 15B and a downwardly tapered slide surface 15A.

Figure 4A:
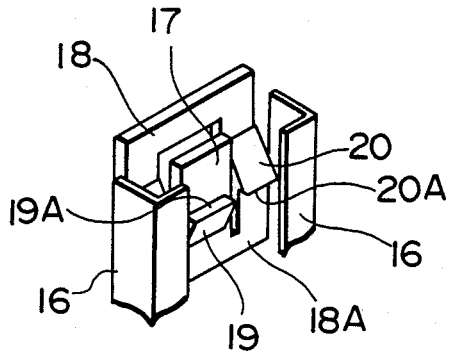
FIGS. 4A and 4B are perspective views of the mounting framework in FIG. 2 taken in the direction of T and U, respectively.
Figure 4B:
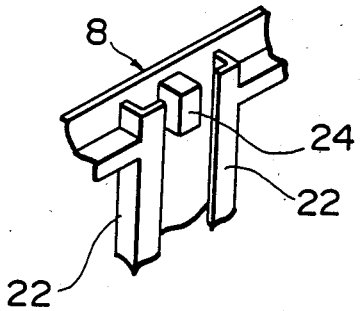

On the other hand, as shown in FIG. 4A, the mounting framework 8 is provided on its one inner end wall with guide rails 16 for cooperation with the insertion guide 13, and within a cavity defined between the guide rails 16 and the inner wall are provided a first release lever 17 and a second release lever 18, both being of a plate shape and resilient material, and extending integrally from and upwardly of the mounting framework 8. The first release lever 17 is provided with a third lock pawl 19 of similar material and shape having an upwardly facing lock surface 19A adapted for engagement with the first lock pawl 14 on the insertion guide 13 of the insulating housing 5. In like manner, the second release lever 18 is provided with a pair of fourth lock pawls 20,20 also of similar material and shape adapted for engagement with the corresponding second lock pawls 15 through their downwardly facing lock surfaces 20A.

Figure 3B:
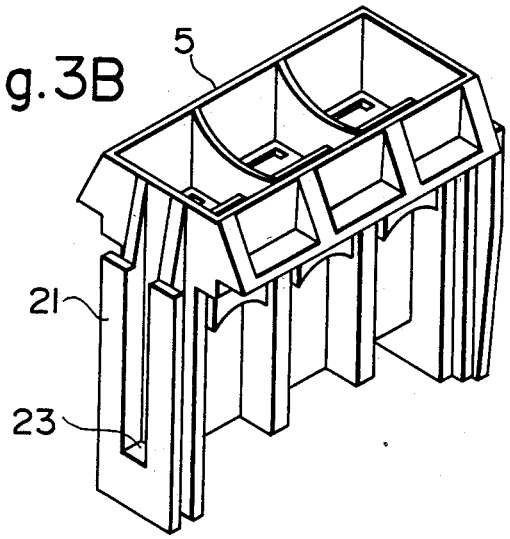

The insulating housing 5, further, is provided at the other and wall with a further plate-shaped insertion guide 21 having a top end opened elongate slot 23 formed centrally (See FIG. 3B). The mounting framework 8 is provided at its other inner end wall with guide rails 22,22 adapted for engagement with the insertion guide 21 of the insulating housing 5, and betwen the guide rails 22,22 is provided a stopper 24 secured on the inner wall of the mounting framework 8 (See FIG. 4B).

With the construction of the inventive device described above, it operates as follows.

Figure 5:
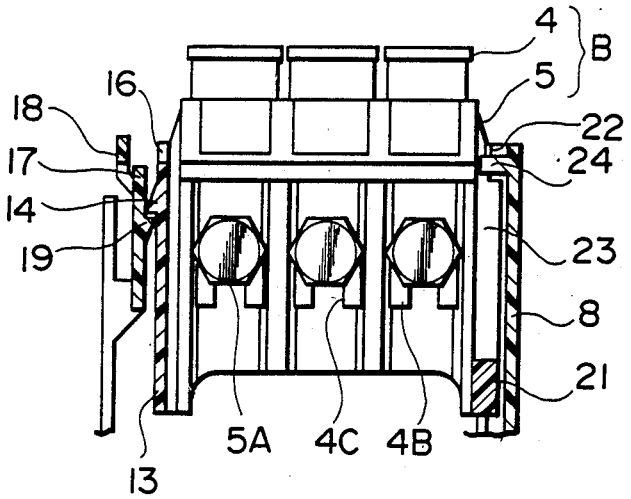
FIG. 5 is an elevational section showing how the insulating housing and the mounting framework are interlocked.
Figure 6:
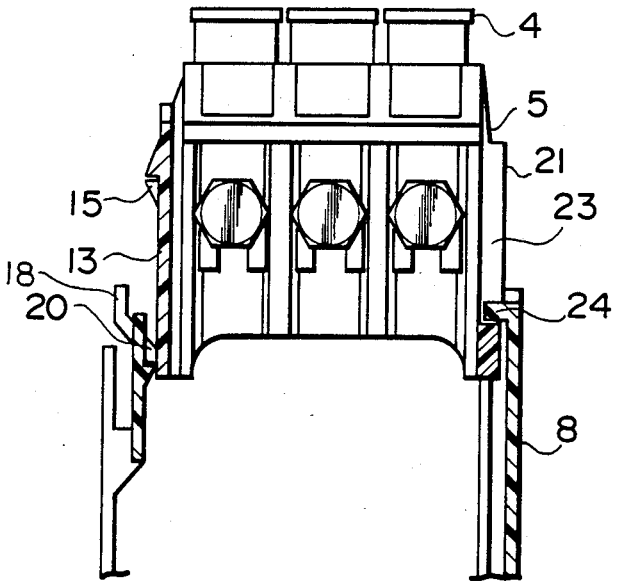
FIG. 6 is a section similar to FIG. 5 showing the insulating housing being pulled upwardly of the mounting framework.

When, as shown in FIG. 5, the insulating housing 5 (or FL connector) is inserted into the mounting framework 8 of the junction block from below with its insertion guide plates 13 and 21 being in alignment with the guide rails 16 and 22, respectively, the first lock pawl 14 on the insertion guide 13 slides upwardly upon the third lock pawl 19 while the resilient release lever 17 being gradually bent toward the inner wall of the mounting framework 8. As soon as the first pawl 14 then passes over the third pawl 19, the lever 17 will spring back or restore its original position. This results in a snap engagement between the two lock pawls 14 and 19 with their respective lock surfaces 14A and 19A abutted against each other. From this condition, the insulating housing 5 is prevented from being pulled downwardly relative to the mounting framework 8 unless the manipulation of the first release lever 17 for pawl disengagement takes place. At the same time, the upwardly facing surfaces 15A of the second pawls 15 abut against the downwardly facing surfaces 20A of the fourth pawls 20. This prevents the insulating housing 5 from being pulled upwardly unless the manipulation of the second release lever 18 for pawl disengagement takes place.

Thus, the insulating housing 5 is securely locked in position, between the lock suraces 19A and 20A of the third and fourth lock pawls 19 and 20, respectively, relative to the mounting framework 8.

When it is desired to effect inspection or replacement of the inner components due to blowout of the fusible links 4, etc., the second lever 18 may be flexed toward the inner wall of the framework 8 so as to disengage the fourth pawls 20 from the second pawls 15, thus enabling the insulating housing 5 to be pulled upwardly relative to the mounting famework 8. Since, on this occasion, the bottom of the slot 23 on the guide 21 is engaged by the stopper 24, it is possible to avoid the risk of the insulating housing being inadvertently detached from the junction block A (See FIGS. 5 and 6). This assures favourable accessibility to the interior components of the FL connector for maintenance or servicing, simply by opening the top cover of the junction.

When further desired to fit the FL connector, which has once been displaced upwardly relative to the junction block, again into the mounting framework, it only suffices to push the FL connector downwardly into the mounting framework.

In this manner, there is provided according to the invention, a double interlock feature which, if necessary, permits upward and downward displacement of the insulating housing from its once locked position through the manipulation of the first and second release levers. This feature obviously is of significant advantage in the inspection or servicing operation, since the operation can be made simpler and quicker simply by opening the top cover of the junction block.

The invention has so far been illustrated and described as applied to the FL connector which is typically subjected to the need of frequent disassembly for replacement or inspection of the inner components. It, however, is in no way limited to that particular connector but can be applied equally to any other types of connector the housing of which is designed as removable.

It is to be noted as regards the orientation of the wedge-like lock pawls 14, 15, 19 and 20 that the first pawl 14 tapers upwardly relative to the side wall of the housing 5 while the third mating pawl 19 tapers reversely; the second powls 15 taper downwardly while the mating fourth pawls 20 taper upwardly.

Though the two spaced second pawls 15 have been shown in the embodiment, a single one may alternatively be employed, instead.

Further, the lock pawls have been described as of generally wedge-shaped configuration, however, they may be of any other proper configuration provided that the relative sliding movement of the two mating pawls finally terminates in a snap action of the two mating lock surfaces making contact with each other under the effect of suitably prepared resilience of the release levers.

Still further, it is preferably designed that the clearance t between the lock surfaces 14B and 15B (See FIG. 3A) of the first and second pawls 14 and 15, respectively, be as small as possible so that any shakiness of the mating parts occurring when the interlock is effected may be avoided.

Referring to the first and second release levers 17 and 18, they have been described as extending from and integrally with the inner wall. More specifically, the first lever 17 is formed integral with and by cutting out a rising base portion 18A of the inner wall while the second lever 18 is formed as part of the inner wall in the shape of a gate via the rising base portion 18A (See FIG. 4A). However, both of the two release levers may alternatively be formed independently of the inner wall of the mounting framework 8.

Figure 11:
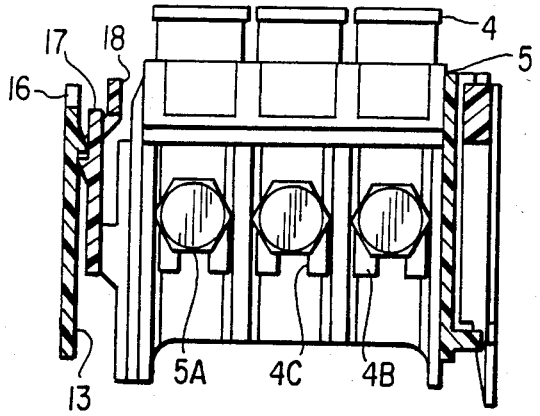
FIG. 11 is an elevation section showing the insulation housing and the mounting framework of another embodiment of the invention.
Figure 12:
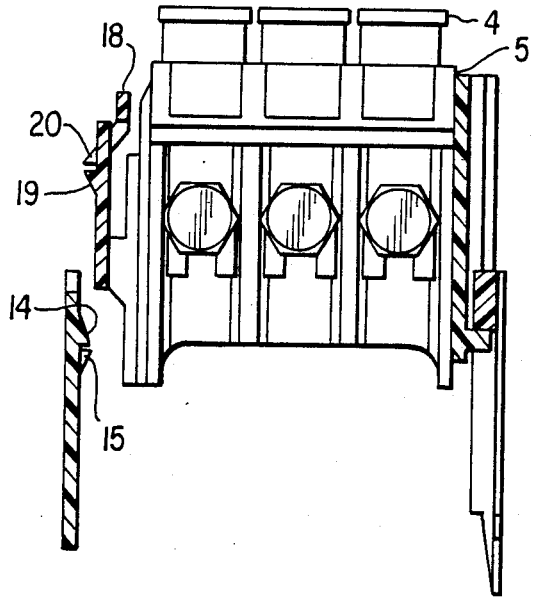
FIG. 12 is a section similar to FIG. 5A showing the insulating housing of the embodiment of FIG. 11 being pulled upwardly out of the mounting framework.

Yet further, in the design of the inventive double interlock mechanism, it is also possible that all of the lock elements so far mentioned are provided in an arrangement opposite to that specified above, that is, the insertion guide 13 carrying the first and second lock pawls 14 and 15 are provided on the inner wall of the mounting framework of the junction block while the first and second release levers 17 and 18 carrying the third and fourth lock pawls 19 and 20, along with the guide rails 16, are provided on the one side wall of the insulating housing as shown in FIGS. 11 and 12, with operational effects equal to those obtained by the above embodiment.

As will be obvious to those skilled in the art, other changes and modifications may be made without departing from the scope of the invention.

What is claimed is:

1. An interlock device for a connector—junction block assembly wherein said connector includes connector terminals accommodated in an insulating housing, said junction block forming therein a mounting framework for slidably detachably mounting said connector therein, characterized in that:

said insulating housing is provided at one side wall thereof with an insertion guide extending in a direction of inserting the connector into said mounting framework, said insertion guide being provided at an upper half portion thereof with a first lock pawl of wedge shape having an upwardly tapered slide surface and downwardly facing horizontal lock surface, and a second lock pawl arranged at immediately below and close to the first lock pawl, said second lock pawl having a downwardly tapered slide surface and an upwardly facing lock surface; and said mounting framework is provided on a protion of an inner wall thereof confronting said one side wall of the insulating housing with guide rails for cooperating with said insertion guide on the insulating housing, and within a cavity defined between said guide rails and the inner wall of the mounting framework are provided a first release lever of resilient material and a second release lever of resilient material extending upwardly from said mounting framework from said inner wall, said first release lever being provided on an inner surface thereof with a third lock pawl having a downwardly tapered surface and an upwardly facing lock surface, said third lock pawl being adapted for engagement with said first lock pawl when said connector and said junction block are interlocked, said second release lever being provided on the inner surface thereof with a fourth lock pawl having an upwardly tapered slide surface and a downwardly facing lock surface, said fourth lock pawl being adapted for the engagement with said second lock pawl when said connector and said junction block are interlocked;

whereby there is provided a double interlock mechanism wherein after the interlock is effected by the manipulation of said first release lever said first and third lock pawls can be disengaged from each other thus allowing the connector to be pulled downwardly relative to the mounting framework while by the manipulation of said second release lever said second and fourth lock pawls can be disengaged from each other thus allowing the connector to be pulled upwardly relative to said mounting framework.

2. An interlock device according to claim 1, further characterized in that said insulating housing is provided on the other side wall thereof with a guide plate having a middle elongated slot open at the top while the mounting framework is provided, on a portion of the inner wall thereof confronting said guide plate, with guide rails for cooperating with said guide plate on the insulating housing and a stopper between and atop said guide rails adapted for slidable engagement in said elongated slot.

3. An interlock device according to claim 1, further characterized in that the vertical distance from the lock surface of the first lock pawl to the lock surfaces of the second lock pawls and that from the lock surface of the third lock pawl to the lock surfaces of the fourth lock pawls are selected as small as possible.

4. An interlock device according to claim 1 further characterized in that the first and third lock pawls or the second and fourth lock pawls are substantially the same in configuration with the same gradient of tapered slide surface.

5. An interlock device for a connector—junction block assembly wherein said connector includes connector terminals accommodated in an insulating housing, said junction block forming therein a mounting framework for slidably detachably mounting said connector therein, characterized in that:

said mounting framework is provided, on a portion of an inner wall confronting one side wall of said insulating housing, with an insertion guide extending in a direction of inserting the connector into said mounting framework, said insertion guide being provided at an upper portion thereof with a first lock pawl of wedge shape having an upwardly tapered slide surface and a downwardly facing horizontal lock surface, and a second lock pawl arranged at immediately below and close to said first lock pawl, said second lock pawl having a downwardly tapered slide surface and an upwardly facing lock surface; and said insulating housing is provided, at one side wall thereof confronting said portion of said inner wall of said mounting framework, with guide rails for cooperating with said insertion guide on said mounting framework, and a cavity defined between said guide rails and an outer surface of said one side wall of said insulating housing is provided with a first release lever of resilient material and a second release lever of resilient material extending upwardly from said one side wall of the insulating housing, said first release lever being provided on the outer surface thereof with a third lock pawl having a downwardly tapered slide surface and an upwardly facing lock surface, said third lock pawl being adapted for engagement with said first lock pawl when said connector and said junction block are interlocked, said second release lever being provided on the outer surface thereof with a fourth lock pawl having an upwardly tapered slide surface and a downwardly facing lock surface, said fourth lock pawl being adapted for engagement with said second pawl when said connector and said junction block are interlocked;

whereby there is provided a double interlock mechanism wherein after the interlock is effected, by the manipulation of said first release lever, said first and third lock pawls can be disengaged from each other thus allowing the connector to be pulled downwardly relative to the mounting framework, and by the manipulation of said second release lever said second and fourth lock pawls can be disengaged from each other thus allowing the connector to be pulled upwardly relative to said mounting framework.

6. An interlock device according to claim 5, further characterized in that said insulating housing is provided on the other side wall thereof with a guide plate having a middle elongated slot open at the top while the mounting framework is provided, on a portion of the inner wall thereof confronting said guide plate, with guide rails for cooperating with said guide plate on the insulating housing and a stopper between and atop said guide rails adapted for slidable engagement in said elongated slot.

7. An interlock device according to claim 5, further characterized in that the vertical distance fro the lock surface of the first lock pawl to the lock surfaces of the second lock pawls and that from the lock surface of the third lock pawl to the lock surfaces of the fourth lock pawls are selected as small as possible.

8. An interlock device according to claim 5, further characterized in that the first and third lock pawls or the second and fourth lock pawls are substantially the same in configuration with the same gradient of tapered slide surface.

* * * * *